US006015772A

United States Patent [19]

Burns et al.

[11] Patent Number: 6,015,772

[45] Date of Patent: Jan. 18, 2000

[54] THERMAL DYE TRANSFER RECEIVING ELEMENT

[75] Inventors: Elizabeth G. Burns; Kristine B. Lawrence, both of Rochester, N.Y.; Wayne A. Bowman, Medina, Ohio; Hwei-Ling Yau, Rochester, N.Y.

[73] Assignee: Eastman Kodak Company, Rochester, N.Y.

[21] Appl. No.: 09/075,082

[22] Filed: May 8, 1998

[51] Int. Cl.[7] ..... B41M 5/035; B41M 5/38

[52] U.S. Cl. ..... 503/227; 428/195; 428/913; 428/914

[58] Field of Search ..... 8/471; 428/195, 428/411.1, 500, 913, 914

[56] References Cited

U.S. PATENT DOCUMENTS 5,529,972 6/1996 Ramello et al. ..... 503/227

*Primary Examiner*—Bruce Hess

*Attorney, Agent, or Firm*—Harold E. Cole

[57] ABSTRACT

A dye-receiving element for thermal dye transfer comprising a support having on one side thereof a dye image-receiving layer comprising a vinyl latex polymer having the following general formula:

$$A_a\text{-}B_b\text{-}C_c$$

wherein:

A is derived from monomers which, when homopolymerized, yield a polymer having a Tg greater than 25;

a is between 5 and 45 mole percent;

B is derived from monomers which, when homopolymerized, yield a polymer having a Tg less than 10;

b is between 35 and 90 mole percent;

C is a repeat unit derived from the salt of an anionic water-soluble monomer; and c is between 0 and 20 mole percent.

15 Claims, No Drawings

THERMAL DYE TRANSFER RECEIVING ELEMENT

FIELD OF THE INVENTION

This invention relates to dye-receiving elements used in thermal dye transfer, and more particularly to vinyl latex dye image-receiving layers for such elements.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye receiving elements used in thermal dye transfer generally include a support (transparent or reflective) bearing on one side thereof a dye image-receiving layer, and optionally additional layers. The dye-receiving layer comprises a polymeric material chosen from a wide assortment of compositions and should have good affinity for the dye. Dyes must migrate rapidly into the layer during the transfer step and become immobile and stable in the viewing environment. One way to immobilize the dye in the receiving element is to transfer a laminate layer from the donor element to the receiver after the image has been generated.

DESCRIPTION OF RELATED ART

U.S. Pat. No. 5,529,972 relates to a dye-receiver for thermal dye transfer wherein the dye-receiving layer may be a styrene-acrylic latex. However, there is a problem with the specific styrene-acrylic latex disclosed in that dyes which are transferred to the styrene-acrylic latex during thermal processing exhibit high dye fade when exposed to light.

It is an object of this invention to provide a receiver element for thermal dye transfer processes with a dye image-receiving layer that is water-coatable. It is another object of the invention to provide a receiver element for the thermal dye transfer process that will minimize dye fade.

SUMMARY OF THE INVENTION

These and other objects are achieved in accordance with this invention which comprises a dye-receiving element for thermal dye transfer comprising a support having on one side thereof a dye image-receiving layer comprising a vinyl latex polymer having the following general formula:

$$A_a\text{-}B_b\text{-}C_c$$

wherein:

A is derived from monomers which, when homopolymerized, yield a polymer having a Tg greater than 25° C.;

a is between 5 and 45 mole percent;

B is derived from monomers which, when homopolymerized, yield a polymer having a Tg less than 10° C., b is between 35 and 90 mole percent;

C is a repeat unit derived from the salt of an anionic water-soluble monomer; and c is between 0 and 20 mole percent.

DESCRIPTION OF THE PREFERRED EMBODIMENTS

In the above formula, A can be, for example, styrene, methyl methacrylate, t-butylacrylamide, isobornyl acrylate, isobornyl methacrylate, or ethyl methacrylate; B can be butyl acrylate, 2-ethylhexylmethacrylate, 2-ethylhexylacrylate, lauryl acrylate, or lauryl methacrylate; and C can be methacrylic acid, sodium salt; sulfoethylacrylate, sodium salt; sulfopropylacrylate, potassium salt; acrylic acid, sodium salt; or 2-acrylamido-2-methylpropanesulfonic acid, sodium salt.

As used herein, vinyl means an unsaturated molecule which polymerizes under common free radical polymerization conditions and latex means a suspension of solid particles in water.

Following are examples of vinyl latex polymers which can be used in accordance with the invention:

TABLE 1

| Polymer | Monomer A (Mole %) | Butyl Methacrylate (Mole %) | Monomer C (10 mole %) | Tg, (° C.) |
|---|---|---|---|---|
| P-1 | Methyl methacrylate (15) | 75 | Methacrylic acid, sodium salt | 61 |
| P-2 | Methyl methacrylate (15) | 75 | Sulfoethylacrylate, sodium salt | 45 |
| P-3 | Styrene (15) | 75 | Acrylic acid, sodium salt | 53 |
| P-4 | Styrene (30) | 60 | Acrylic acid, sodium salt | 52 |
| P-5 | Styrene (45) | 45 | Acrylic acid, sodium salt | 63 |
| P-6 | Styrene (15) | 75 | Methacrylic acid, sodium salt | 55 |
| P-7 | Styrene (30) | 60 | Methacrylic acid, sodium salt | 63 |
| P-8 | Styrene (45) | 45 | Methacrylic acid, sodium salt | 67 |
| P-9 | Styrene (30) | 60 | Sulfoethylacrylate, sodium salt | 40 |
| P-10 | Styrene (45) | 45 | Sulfoethylacrylate, sodium salt | 45 |
| P-11 | Styrene (15) | 75 | 2-acrylamido-2-methylpropanesulfonic acid, sodium salt | 36 |
| P-12 | Styrene (30) | 60 | 2-acrylamido-2-methylpropanesulfonic acid, sodium salt | 43 |
| P-13 | Styrene (45) | 45 | 2-acrylamido-2-methylpropanesulfonic acid, sodium salt | 48 |

The above polymers may be employed at a concentration ranging from about 0.5 g/m$^2$ to about 10 g/m$^2$ and may be coated from organic solvents or water if desired.

The support for the dye-receiving element of the invention may be transparent or reflective, and may be a polymeric, a synthetic paper, or a cellulosic paper support, or laminates thereof. In a preferred embodiment, a paper support is used. In a further preferred embodiment, a polymeric layer is present between the paper support and the dye image-receiving layer. For example, there may be employed a polyolefin such as polyethylene or polypropylene. In a further preferred embodiment, white pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150; 4,965,238; 4,965,239; and 4,965,241, the disclosures of which are incorporated by reference. The receiver element may also include a backing layer such as those disclosed in U.S. Pat. Nos. 5,011,814 and 5,096,875, the disclosures of which are incorporated by reference.

Dye-donor elements that are used with the dye-receiving element of the invention conventionally comprise a support having thereon a dye-containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112; 4,927,803 and 5,023,228, the disclosures of which are incorporated by reference.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. Alternatively, other known sources of energy for thermal dye transfer may be used, such as lasers as described in, for example, GB 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLES

Example 1

Preparation of Acrylate Latex Polymer P-1

This polymer was prepared by purging 475 mL water with nitrogen in a three-neck, round-bottom flask equipped with an overhead stir motor and an inlet/addition adapter. Dowfax 2A1® (14 mL; Dow Chemical Company) was added to the nitrogen purged flask. This flask was held at 80° C. In a three-neck addition funnel equipped with an overhead stir motor and a nitrogen inlet, 225 mL of water was purged with nitrogen. To the stirring, purged water in the addition flask was added, in this order, Dowfax 2A1® (14 mL) 19.0 g methacrylic acid, 235 g butylmethacrylate and 33 g methylmethacrylate. Potassium persulfate (3.0 g) and 1 g of sodium metabisulfite were added to the reaction flask, and the addition of the monomers was started immediately. The monomer suspension was added to the reaction flask at a rate of 15 mL/min, and was completed in forty minutes. At the end of the addition, an additional 3 g of potassium persulfate was added, and the reaction was stirred at 80° C. for two hours. After cooling to room temperature, the reaction was neutralized to a pH of 7.0 with 19 mL of a 15% wt/wt solution of sodium hydroxide.

Polymers P-2 through P-13 were prepared in an analogous manner to the preparation of P-1 and the corresponding compositions can be found in Table 1.

Example 2

Synthesis of Acrylamide Polymer P-14

This polymer was prepared by first purging 2258.3 g of water in a three-neck addition funnel equipped with an overhead stir motor and a nitrogen inlet. To the stirring, purged water in the addition flask was added sodium $C_{14}$–$C_{16}$ olefin sulfonate (70 g @ 40% solids, Wiconate® AOS, Witco Chemical Company) and 750 g butylacrylate. This emulsion was allowed to stir overnight before adding 750 g t-butylacrylamide, which was allowed to stir for five minutes before beginning the addition. The reaction flask was prepared by purging 1127.17 g water with nitrogen in a three-neck, round-bottom flask equipped with an overhead stir motor and an inlet/addition adapter. Wiconate® (37.5 g @ 40% solids) was added to the nitrogen purged flask. This flask was held at 80° C. Potassium persulfate (1.5 g) was added to the reaction flask, and the addition of the monomers was started immediately thereafter. The monomer suspension was added to the reaction flask at a rate of 32 mL/min, and was completed in two hours and 14 minutes. At the end of the addition the reaction was stirred at 80° C. twenty minutes. After cooling to room temperature, the reaction was filtered.

Polymers P-15 through P-18 were prepared in a fashion analogous to that of P-14 and the corresponding compositions can be found in Table 2.

TABLE 2

| Polymer | t-butyl acrylamide (mole %) | Monomer B (mole %) | Tg (° C.) |
|---|---|---|---|
| P-14 | 60 | Butylacrylate (40) | 27 |
| P-15 | 50 | Butylacrylate (50) | 40 |
| P-16 | 61 | 2-ethylhexylmethacrylate (39) | 54 |
| P-17 | 59 | 2-ethylhexylacrylate (41) | 53 |

TABLE 2-continued

| Polymer | t-butyl acrylamide (mole %) | Monomer B (mole %) | Tg (° C.) |
|---|---|---|---|
| P-18 | 65 | Lauryl acrylate (35) | 56 |

Example 3

Preparation of Dye-receiving Elements E-1 through E-18

These elements were prepared by first extrusion-laminating a paper core with a 38 μm thick microvoided composite film (OPPalyte® 350TW, Mobil Chemical Co.) as disclosed in U.S. Pat. No. 5,244,861. The composite film side of the resulting laminate was then coated with the following layers in the order recited:

1) a subbing layer of 0.02 g/m$^2$ Polymin P® polyethyleneimine (BASF Corporation) coated from distilled water
2) and a dye-receiving layer composed of a mixture of 3.23 g/m$^2$ of aqueous dispersions of latexes P-1 through P-18 and 0.022 g/m$^2$ of a fluorocarbon surfactant (Fluorad FC-170C®, 3M Corporation), coated from distilled water.

Control receiver element C-1 was prepared as described above except CP-1 was used in place of P1 through P-18. CP-1 is Lipaton Ae 4620®, Polymer Latex Inc., analogous to Inv. 1 in Table C of U.S. Pat. No. 5,529,972.

Preparation of Dye Donor Elements:

The following dyes were used in the experimental work:

Cyan Dye 1

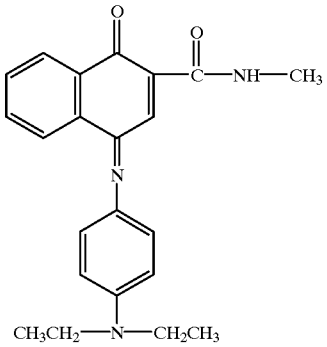

Cyan Dye 2

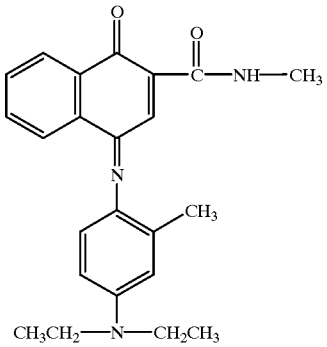

-continued

Cyan Dye 3

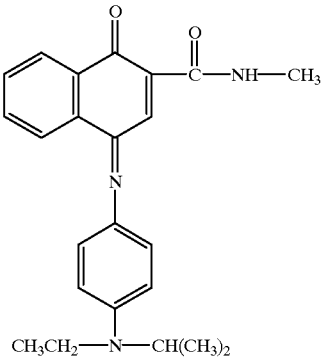

Magenta Dye 1

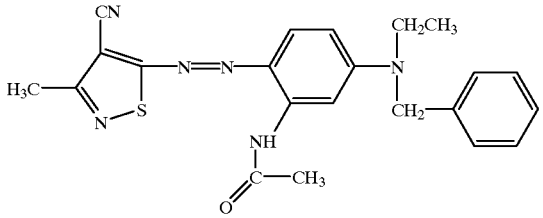

Magenta Dye 2

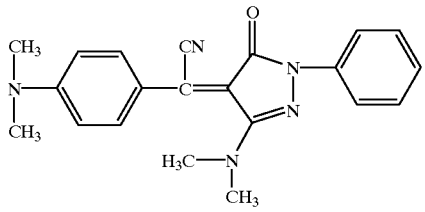

Yellow Dye 1

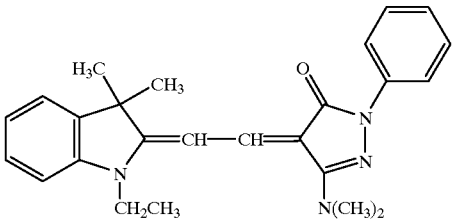

Dye-donor elements were prepared by coating on a 6 μm poly(ethylene terephthalate) support (DuPont Co.):

1) a subbing layer of titanium tetra-n-butoxide (Tyzor TBT®, DuPont Co.) (0.12 g/m$^2$) from a n-propyl acetate/1-butanol (85/15) solvent mixture, and
2) repeating yellow, magenta and cyan dye patches containing the compositions as described below.

The yellow composition contained 0.29 g/m$^2$ of Yellow Dye 1, 0.31 g/m$^2$ of CAP 482-20 (20 s viscosity cellulose acetate propionate, Eastman Chemical Co.), 0.076 g/m$^2$ of CAP 482-0.5 (0.5 s viscosity cellulose acetate propionate, Eastman Chemical Co.), 0.006 g/m$^2$ of 2 μm divinylbenzene crosslinked beads (Eastman Kodak Co.), and 0.0014 g/m$^2$ of Fluorad FC-430® (3M Corporation) from a toluene/methanol/cylcopentanone solvent mixture (70/25/5).

The magenta composition contained 0.17 g/m$^2$ of Magenta Dye 1, 0.18 g/m$^2$ of Magenta Dye 2, 0.31 g/m$^2$ of CAP 482-20, 0.07 g/m$^2$ of 2,4,6-trimethylanilide of phenylindan-diacid, 0.006 g/m$^2$ of 2 μm divinylbenzene crosslinked beads and 0.0011 g/m$^2$ of Fluorad FC-430® from a toluene/methanol/cylcopentanone solvent mixture (70/25/5).

The cyan composition contained 0.14 g/m$^2$ of Cyan Dye 1, 0.12 g/m$^2$ of Cyan Dye 2, 0.29 g/m$^2$ of Cyan Dye 3, 0.31 g/m$^2$ of CAP 482-20, 0.02 g/m$^2$ of CAP 482-0.5, 0.01 g/m$^2$ of 2 $\mu$m divinylbenzene crosslinked beads and 0.0007 g/m$^2$ of Fluorad FC-430® from a toluene/methanol/cylcopentanone solvent mixture (70/25/5).

On the backside of the donor element were coated the following layers in sequence:

1) a subbing layer of titanium tetra-n-butoxide (Tyzor TBT®, DuPont Co.) (0.12 g/m$^2$) from a n-propyl acetate/1-butanol (85/15) solvent mixture, and
2) a slipping layer containing 0.38 g/m$^2$ poly(vinyl acetal) (Sekisui Co.), 0.022 g/m$^2$ Candelilla wax dispersion (7% in methanol), 0.011 g/m$^2$ PS513 aminopropyl-dimethyl-terminated polydimethylsiloxane (Huels) and 0.003 g/m$^2$ p-toluenesulfonic acid coated from 3-pentanone (98%)/distilled water (2%) solvent mixture.

Preparation and Evaluation of Thermal Dye Transfer Images

Eleven-step sensitometric full color (yellow+magenta+cyan) thermal dye transfer images were prepared from the above dye-donor and dye-receiver elements. The dye side of the dye-donor element, approximately 10 cm×15 cm in area, was placed in contact with a receiving-layer side of a dye-receiving element of the same area. This assemblage was clamped to a stepper motor-driven, 60 mm diameter rubber roller. A thermal head (TDK No. 8F10980, thermostatted at 25° C.) was pressed with a force of 24.4 Newton (2.5 kg) against the dye-donor element side of the assemblage, pushing it against the rubber roller.

The imaging electronics were activated causing the donor-receiver assemblage to be drawn through the printing head/roller nip at 40.3 mm/sec. Coincidentally, the resistive elements in the thermal print head were pulsed for 127.75 ms/pulse at 130.75 $\mu$s intervals during a 4.575 ms/dot printing cycle (including a 0.391 ms/dot cool down interval). A stepped image density was generated by incrementally increasing the number of pulses/dot from a minimum of 0 to a maximum of 32 pulses/dot. The voltage supplied to the thermal head was approximately 14.0 v resulting in an instantaneous peak power of 0.369 watts/dot and a maximum total energy of 1.51 mJ/dot; print room humidity: 41–54% RH.

The above printing procedure was done using the yellow, magenta and cyan dye-donor patches. When properly registered, a full color image was obtained. During the printing process, the level of donor-to-receiver sticking was determined visually and rank ordered. A 0 indicates no donor-receiver sticking was observed, a 3 indicates medium levels of sticking and a 5 indicates severe sticking.

To protect the surface of the receiver from typical environmental conditions such as fingerprints, a final lamination layer is transferred to the surface of the receiver, after the dye donor patches have been transferred.

The laminate composition contained 0.45 g/m$^2$ of poly (vinyl acetal) (Sekisui Co.), 0.086 g/m$^2$ of divinyl benzene crosslinked beads (Eastman Kodak Co.), and 0.011 g/m$^2$ of a microgel of poly(isobutyl methacrylate-co-2-ethylhexyl methacrylate-co-divinyl benzene) 67:30:3 wt coated from diethylketone, as disclosed in U.S. Pat. No. 5,387,573.

The laminate support material is pressed against the receiver material in the same printing fixture previously used to transfer the dye donor patches to the receiver. The printhead is energized with the same voltage previously used for printing the dyes. The resistive elements are pulsed 32 times for 118.0 microseconds/pulse at 130.75 microsecond intervals. Thus, the lamination energy is 1.39 milliJoules/dot.

Dye uptake for each laminated print was determined by measuring the optical densities for yellow, magenta and cyan channels at maximum density (step 11) using a X-Rite 820® Densitometer and averaging the numbers. In all cases, a maximum density of 1.5 or more was obtained showing that the receiver polymers effectively accept dye.

The images were then subjected to a high intensity daylight fading test of exposure for 1 week, 50 kLux, 5400° K., approximately 25% RH. The Status A red, green and blue reflection densities for the step of each dye image having an initial density nearest to 1.0 were compared before and after fade, a percent density loss was calculated for the yellow, magenta and cyan channels and these percentages were averaged. The results for averaged dye uptake and averaged percent dye losses are summarized in Table 3 below.

TABLE 3

| Receiver Element | Polymer | Average Dye Uptake* | Average % Dye Fade** |
|---|---|---|---|
| E-1 | P-1 | 1.6 | 10 |
| E-2 | P-2 | 1.6 | 13 |
| E-3 | P-3 | 1.8 | 12 |
| E-4 | P-4 | 1.8 | 10 |
| E-5 | P-5 | 1.9 | 9 |
| E-6 | P-6 | 1.6 | 13 |
| E-7 | P-7 | 1.6 | 10 |
| E-8 | P-8 | 1.8 | 12 |
| E-9 | P-9 | 1.6 | 13 |
| E-10 | P-10 | 1.9 | 13 |
| E-11 | P-11 | 1.8 | 11 |
| E-12 | P-12 | 1.7 | 12 |
| E-13 | P-13 | 1.8 | 9 |
| E-14 | P-14 | 2.3 | 12 |
| E-15 | P-15 | 2.1 | 5 |
| E-16 | P-16 | 1.7 | 7 |
| E-17 | P-17 | 2.0 | 10 |
| E-18 | P-18 | 2.0 | 13 |
| C-1 | CP-1 | 2.1 | 21 |

*averaged dye uptake at maximum density for yellow, magenta and cyan channels

**averaged % dye fade at OD = 1.0 for yellow, magenta and cyan channels

The above data show that receiver elements E-1 through E-18 and the control receiver element C-1 accepted dye effectively (averaged dye uptake >1.5). However, receiver elements composed of a variety of vinyl latex polymers (P-1 through P-1 8) showed lower % dye fade relative to the control receiver element C-1 described in the prior art.

The invention has been described in detail with particular reference to preferred embodiments thereof, but it will be understood that variations and modifications can be effected within the spirit and scope of the invention.

What is claimed is:

1. A dye-receiving element for thermal dye comprising a support having on one side thereof a dye image-receiving layer comprising a vinyl latex polymer having the following general formula:

$$A_a\text{-}B_b\text{-}C_c$$

wherein:

A is derived from monomers which, when homopolymerized, yield a polymer having a Tg greater than 25° C.;

a is between 5 and 45 mole percent;

B is derived from monomers which, when homopolymerized, yield a polymer having a Tg less than 10° C.;

b is between 35 and 90 mole percent;

C is a repeat unit derived from the salt of an anionic water-soluble monomer; and c is between 0 and 20 mole percent, said dye image-receiving layer containing a thermally-transferred dye image.

2. The element of claim 1 wherein A is styrene, methyl methacrylate, t-butylacrylamide, isobornyl acrylate, isobornyl methacrylate, or ethyl methacrylate.

3. The element of claim 1 wherein B is butyl acrylate, 2-ethylhexylmethacrylate, 2-ethylhexylacrylate, lauryl acrylate, or lauryl methacrylate.

4. The element of claim 1 wherein C is methacrylic acid, sodium salt; sulfoethylacrylate, sodium salt; sulfopropylacrylate, potassium salt; acrylic acid, sodium salt; or 2-acrylamido-2-methylpropanesulfonic acid, sodium salt.

5. The element of claim 1 wherein A is t-butylacrylamide.

6. A process of forming a dye transfer image comprising imagewise-heating a dye-donor element comprising a support having thereon a dye layer and transferring a dye image to a dye-receiving element to form said dye transfer image, said dye-receiving element comprising a support having thereon a dye image-receiving layer comprising a vinyl latex polymer having the following general formula:

$$A_a\text{-}B_b\text{-}C_c$$

wherein:

A is derived from monomers which, when homopolymerized, yield a polymer having a Tg greater than 25;

a is between 5 and 45 mole percent;

B is derived from monomers which, when homopolymerized, yield a polymer having a Tg less than 10;

b is between 35 and 90 mole percent;

C is a repeat unit derived from the salt of an anionic water-soluble monomer; and c is between 0 and 20 mole percent.

7. The process of claim 6 wherein A is styrene, methyl methacrylate, t-butylacrylamide, isobornyl acrylate, isobornyl methacrylate, or ethyl methacrylate.

8. The process of claim 6 wherein B is butyl acrylate, 2-ethylhexylmethacrylate, 2-ethylhexylacrylate, lauryl acrylate, or lauryl methacrylate.

9. The process of claim 6 wherein C is methacrylic acid, sodium salt; sulfoethylacrylate, sodium salt; sulfopropylacrylate, potassium salt; acrylic acid, sodium salt; or 2-acrylamido-2-methylpropanesulfonic acid, sodium salt.

10. The process of claim 6 wherein A is t-butylacrylamide.

11. A thermal dye transfer assemblage comprising: (a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer; wherein said dye image-receiving layer comprises a vinyl latex polymer having the following general formula:

$$A_a\text{-}B_b\text{-}C_c$$

wherein:

A is derived from monomers which, when homopolymerized, yield a polymer having a Tg greater than 25;

a is between 5 and 45 mole percent;

B is derived from monomers which, when homopolymerized, yield a polymer having a Tg less than 10;

b is between 35 and 90 mole percent;

C is a repeat unit derived from the salt of an anionic water-soluble monomer; and c is between 0 and 20 mole percent.

12. The assemblage of claim 11 wherein A is styrene, methyl methacrylate, t-butylacrylamide, isobornyl acrylate, isobornyl methacrylate, or ethyl methacrylate.

13. The assemblage of claim 11 wherein B is butyl acrylate, 2-ethylhexylmethacrylate, 2-ethylhexylacrylate, lauryl acrylate, or lauryl methacrylate.

14. The assemblage of claim 11 wherein C is methacrylic acid, sodium salt; sulfoethylacrylate, sodium salt; sulfopropylacrylate, potassium salt; acrylic acid, sodium salt; or 2-acrylamido-2-methylpropanesulfonic acid, sodium salt.

15. The assemblage of claim 11 wherein A is t-butylacrylamide.

* * * * *